United States Patent [19]

Nukushina

[11] Patent Number: 4,796,551

[45] Date of Patent: Jan. 10, 1989

[54] METHOD AND APPARATUS FOR PREPARING SEWING DATA

[75] Inventor: Masanori Nukushina, Chofu, Japan

[73] Assignee: Juki Corporation, Tokyo, Japan

[21] Appl. No.: 117,468

[22] Filed: Nov. 5, 1987

Related U.S. Application Data

[63] Continuation of Ser. No. 890,348, Jul. 25, 1986, Pat. No. 4,704,977.

[51] Int. Cl.[4] ..... D05B 3/02; D05B 21/00

[52] U.S. Cl. ..... 112/266.1; 112/456; 112/121.12

[58] Field of Search ..... 112/456, 458, 457, 453, 112/454, 266.1, 121.12, 103

[56] References Cited

U.S. PATENT DOCUMENTS

| | | | |
|---|---|---|---|
| 4,141,305 | 2/1979 | Takenoya et al. | 112/456 |
| 4,266,493 | 5/1981 | Hanyu et al. | 112/456 X |
| 4,413,574 | 11/1983 | Hirota et al. | 112/121.12 |
| 4,426,946 | 1/1984 | Takenoya et al. | 112/456 |
| 4,572,095 | 2/1986 | Makabe et al. | 112/456 |
| 4,599,959 | 7/1986 | Sano et al. | 112/266.1 |

FOREIGN PATENT DOCUMENTS 58-198381 11/1983 Japan .

*Primary Examiner*—Peter Nerbun

*Attorney, Agent, or Firm*—Morgan & Finnegan

[57] ABSTRACT

Method and apparatus for preparing sewing data for an automatic sewing apparatus which embroiders an embroidery pattern on cloth using a zigzag stitch while moving one or both of a cloth retainer and a sewing machine relative to each other. When a pattern corresponding to a basic sewing data group stored in a memory device is to be embroidered either magnified or reduced in size, in order to set a desired stitch density (P), which is the pitch of the stitches, three items of basic sewing data are read out from the memory device as one processing unit. After these items of data have been multiplied by a specified magnification to obtain sewing data (A,B,C), a pattern range which corresponds to the sewing data is divided by a particular stitch density in order to calculate correction data ((1) to (21)). Then a plurality of correction data items which correspond to the magnification of the specified stitch density with respect to the particular stitch density are added together to provide sewing data ((1') to (9')).

7 Claims, 5 Drawing Sheets

METHOD AND APPARATUS FOR PREPARING SEWING DATA

This is a continuation of co-pending application Ser. No. 890,348 filed July 25, 1986 now U.S. Pat. No. 4,704,977.

BACKGROUND OF THE INVENTION

The invention relates to methods of preparing sewing data for an automatic zig-zag embroidery machine which moves itself or causes a work piece to move in response to sewing data stored in a memory device and thereby embroiders a desired zig-zag stitch embroidery pattern.

In automatic zig-zag sewing machines, it is a general practice to magnify basic sewing data by applying a multiplier rather than using basic sewing data as stored. But when embroidery is performed according to the magnified sewing data, since the stitch interval (the spacing between threads) is magnified by the same multiplier, the stitch interval may be too wide. Additionally, in some instances, threads are crossed or overlapped resulting in a poor looking embroidery pattern.

Accordingly, there is a need for a method of preparing sewing data in order to maintain a good pattern appearance when the stitch pattern is magnified or reduced in size.

SUMMARY OF THE INVENTION

With the foregoing in mind, it is an object of the invention to provide a new and improved method of preparing sewing data in an automatic sewing apparatus.

Briefly described, three basic sewing data items are read out of memory as one process unit and are multiplied by a multiplier N. Calculations for adjusting the data by dividing the pattern into a minimum stitch interval (0.1 mm) are then performed Thereafter, the plurality of adjusted data which corresponds to the selected stitch interval are added together and the summation regarded as the new stitch data.

The new stitch intervals are then adjusted to maintain a good stitch pattern appearance even though the original pattern has been scaled up or down. Since the new stitch interval has been adjusted to 0.1 mm, adjustment of the new stitch interval can be accomplished by multiplying by an integer. Thus, adjustment for the required new stitch interval is easily performed.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figure 1:
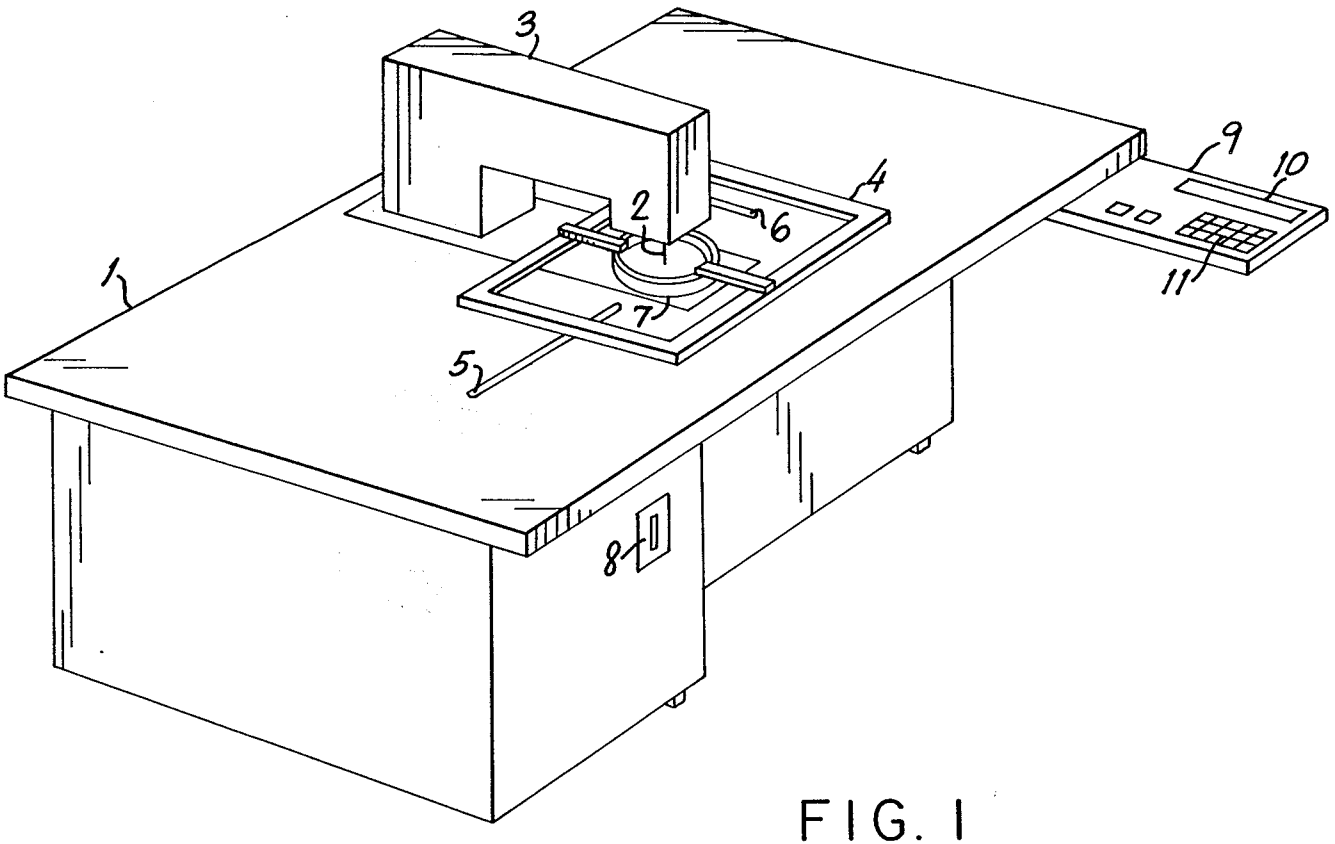
FIG. 1 is a perspective view of a sewing machine according to the invention.

FIG. 1 shows a perspective view of a stitching machine according to the invention wherein numeral 1 denotes a work-table and numeral 3 generally denotes a sewing machine that includes a needle 2 that repeats an up-down motion in association with a hook under the work-table 1. Numeral 4 denotes a movable rectangular frame retainer placed on the work-table 1. Numerals 5, 6 denote narrow rectangular holes provided on the work-table 1 in direction of coordinates X, Y Although the embodiment described herein illustrates the movement of the cloth retainer relative to the sewing machine body, it will be appreciated by those skilled in the art that similar results may be obtained by moving one or both of the cloth retainer and sewing machine body relative to each other.

Figure 2:
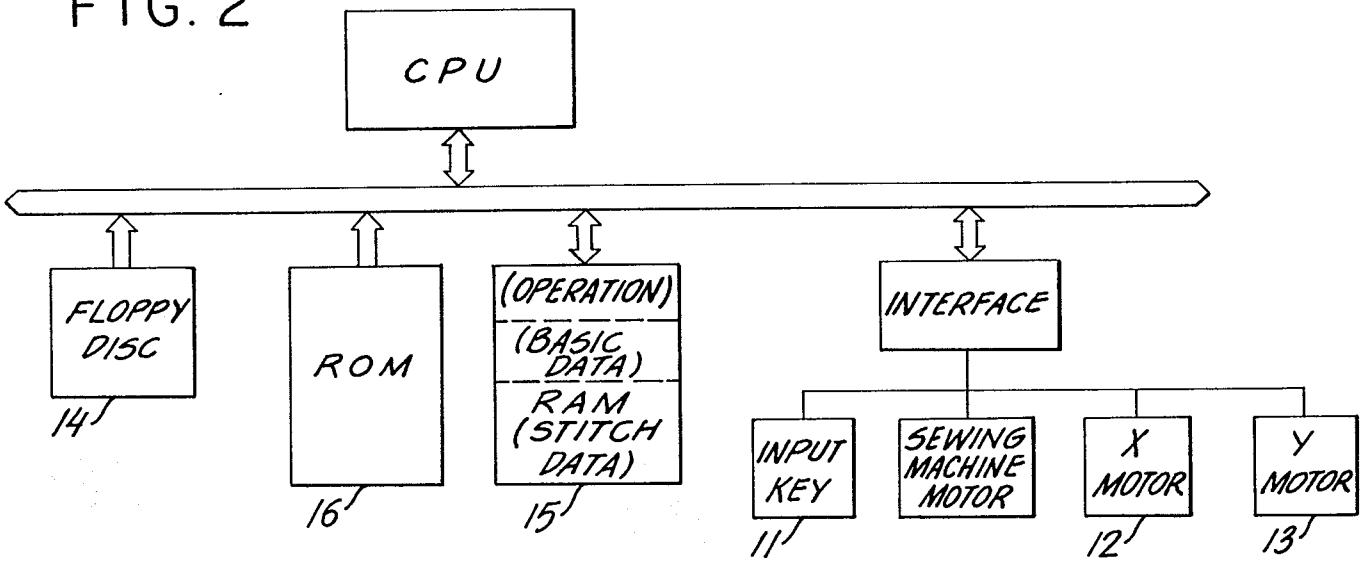
FIG. 2 is an electrical block diagram according to the invention.

The frame retainer 4 is connected to a X-carriage and a Y-carriage (neither shown in drawings) through the two holes 5, 6. The X-carriage and Y-carriage are connected to stepping motors 12, 13 respectively (refering to FIG. 2). The frame retainer 4, X-carriage, Y-carriage, and stepping motors 12, 13 form a feeding device.

Numeral 7 denotes a circular or elliptical shaped workpiece holder comprising an outer frame and an inner frame. Such workpiece holders for holding the workpiece between the frames are well known in the art. The workpiece holder 7 is detachable from the frame 4.

Numeral 8 indicates an opening for insertion of a floppy disc 14. In the floppy disc, a plurality of pattern stitch data (in this embodiment, "A" to "Z") including a plurality of stitches is stored in RAM (Random Access Memory).

Figure 3:
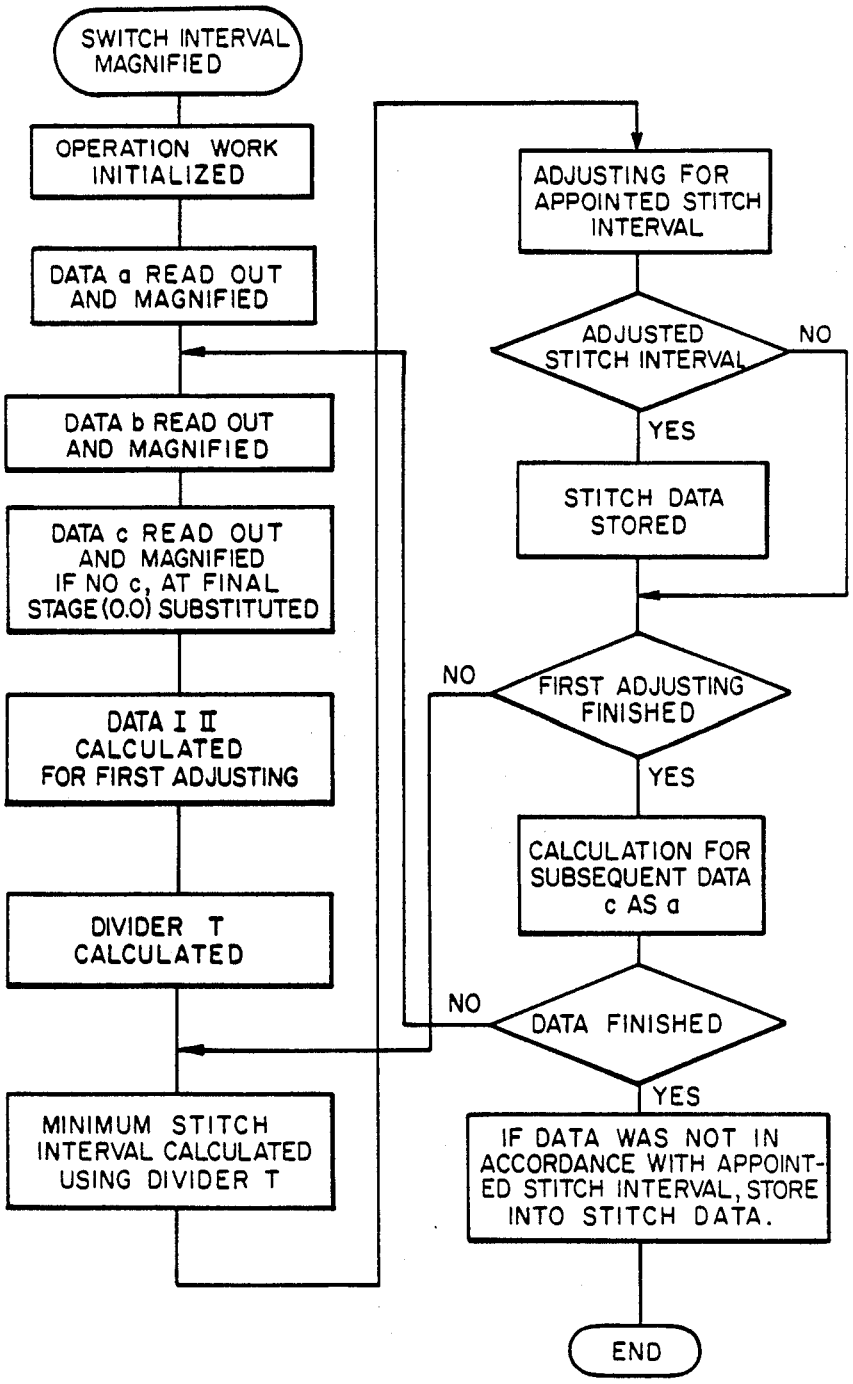
FIG. 3 is a flow chart according to the invention.

Numeral 9 denotes a console panel attached to the work-table 1, and includes a display 10 which displays messages from a micro computer, command keys 11 for "START", "STOP", etc., and operation keys 11 which generate commands to address the data groups stored in the floppy disc (the first memory means). The micro computer comprises a RAM 15 (the second memory means), ROM (Read Only Memory) 16 (the third memory means), and a CPU (Central Processing Unit) 17. In the ROM 16, the Program to perform the steps illustrated in the flow chart shown in FIG. 3 is stored. This process being described in greater detail below.

Operation of the sewing machine is as follows: First, the floppy disc 14 is inserted into the opening 8 and is set. The electric source switch is switched on, and the apparatus initialized. Simultaneously, the sewing machine is adjusted such that the needle 2 is positioned at its upper dead point. Then, a multiplier of pattern data N, and a stitch interval P are set by keys 11, for example N=2 and P=3 (0.3 mm). The display 10 then displays the message "DETERMINE STITCH PATTERN" and the operator selects or addresses the sewing pattern. Thereafter, the process for preparation of the stitch data starts as shown in the flow chart in FIG. 3.

Figure 4:
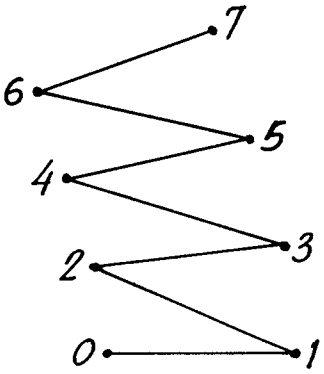
FIG. 4 is a typical stitch pattern based on basic sewing data.

Assuming the stitch data corresponding to the needle drop points of the selected pattern are in the order of points 0, 1, 2, 3, ... 7 of FIG. 4, first, the area of RAM 15 used to temporarily store data during operations is initialized and the stitch data of the selected stitch pattern is read from floppy disc 14 and stored in the basic data area of the RAM 15. Stitch data items are transferred to the operation work area keeping the three data elements a, b, c, as shown in FIG. 5A as one process unit.

In the operation work area, the "ENLARGEMENT", "CALCULATION OF DIVIDER", "ADJUSTMENT OF MINIMUM STITCH INTERVAL", and "ADJUSTMENT OF SELECTED STITCH INTERVAL" functions are executed as described below, and the final adjusted stitch data is stored in the stitch data area of RAM 15. Then the basic data items of the one process unit are read into the operation work area of RAM 15.

Repeating the above process, the desired stitch data are derived from the basic data and the desired stitch data are stored in the stitch data area of RAM 15. Of the three data elements 1, 2, 3 of the one process unit (see FIG. 5A), the third data element 3 is regarded as the first data element 1 of any subsequent process unit. When there is no third data element 3, this third data element is regarded as (0, 0) and the same process repeated.

A. ENLARGEMENT

The data items stored in the operation area of the RAM 15 are the data items corresponding to the stitch a, b, c, of FIG. 5A and which corresponds to segments 0-1, 1-2, 2-3 of FIG. 4. If these data items are determined as $(x_1, y_1)$, $(x_2, y_2)$, $x_3$, $y_3$) and the multiplier N=2, each stitch a,b,c is magnified as follows:

$$(2x_1, 2y_1)=X_1, Y_1$$

$$(2x_2, 2y_2)=X_2, Y_2$$

$$(2x_3, 2y_3)=X_3, Y_3$$

Figure 5B:
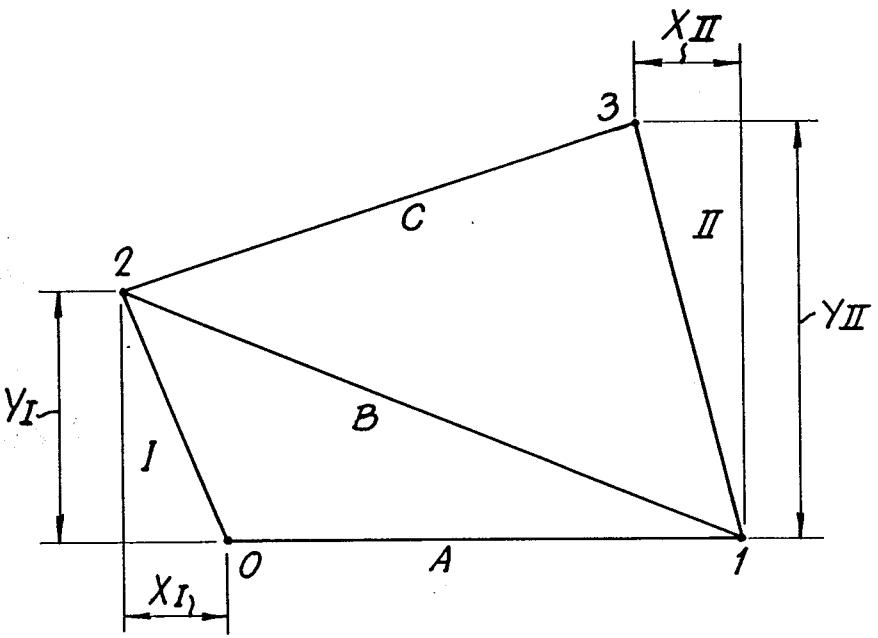
FIGS. 5A–5D are explanatory diagrams showing how a stitch pattern is drafted.
Figure 5A:
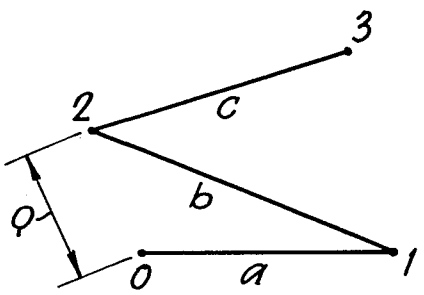

The stitch line a, b, c in FIG. 5A corresponds to stitch line A, B, C in FIG. 5B. The tetragon comprising the three data elements a, b, c in FIG. 5A which correspond to segments 0-1, 1-2, 2-3 in FIG. 4 is regarded as one process unit.

Referring to FIG. 5A, the X, Y values of needle drop points 1, 2, and 3 may be expressed as (10, 0), (−12, 5)., and (10, 3), respectively. The X, Y values of point 1 (10, 0) are based on using the point 0 (0, 0) as the origin, the X, Y values of point 2 (−12, 5) are based on using the point 1 as the origin and the X, Y values of point 3 (10, 3) are based on using the point 2 as the origin. Each unit of the X, Y values is 0.1 millimeters, and when multiplied by two (N=2), each of the points 1, 2, 3 become (20, 0), (−24, 10), and (20, 6).

B. CALCULATION OF DIVIDER

Referring to FIG. 5B, each side of triangle I and triangle II are determined to be, for example, $X_1=|4|$, $Y_1=|10|$, $X_{II}=|4|$, and $Y_{II}=|61|$ (|4| meaning the absolute value of 4). The X, Y values are derived as follows:

$$X_I=X_1+X_2=20-24=-6=|4|$$

$$Y_I=Y_1+Y_2=0+10=10=51\ 10|$$

$$X_{II}=X_2+X_3=-24+20=-4=|4|$$

$$Y_{II}=Y_2+Y_3=10+6=16=|16|$$

Referring to triangle I and triangle II in FIG. 5B. the larger value of each of the X, Y values is selected. IN the case of triangle I, $X_1=4$ and $Y_1=10$, so $Y_I=10$ is selected. In the case of triangle II, $X_{II}=4$ and $Y_{II}=16$, so $Y_{II}=16$ is selected. Comparing $Y_I=10$ with $Y_{II}=16$, $Y_I=10$ is selected and this value is regarded as the divider. $Y_{II}=16$ may also be selected, but in this embodiment, $Y_I=10$ is used.

ADJUSTMENT OF MINIMUM STITCH INTERVAL (0.1 mm)

Adjustment of the minimum stitch interval (the first adjustment) is accomplished by calculating the X, Y data values of each position and dividing by the above-selected divider 10. Each X, Y value is determined using the previous point as the origin. The divided points are expressed as $I_I \sim I_9$ and $II_1 \sim II_9$ as shown in FIG. 5C. The X, Y data values of the divided points are derived as follows:

$$\text{First adjustment for } X \text{ or } Y = -\text{Previous } X \text{ or } Y \text{ data} + \frac{\text{divide index number} \times \text{adjusted data}}{\text{divider}} - \text{Previous adjusted } X \text{ or } Y \text{ data}$$

"Divide index number" is a number representing the stitching order number, 1~10 (for $I_1 \sim I_{10}$) or 1~9 (for $II_1 \sim II_9$) as shown in FIG. 5C. For example, in the case of $I_1$, $II_1$ the divide index number is 1 and in the case of $I_2$, $II_2$, the divide index number is 2. "Adjusted data" is the $X_I$ or $X_{II}$ values for the X component, and the $Y_I$ or $Y_{II}$ values for the Y component. "Previous adjusted data" is the calculated data derived in the previous calculation, namely $$\frac{\text{divide index number} \times \text{adjusted data}}{\text{divider}}$$

shown in the previous calculation.

Referring to FIG. 5C, in the case of segment ①, data A of FIG. 5B is regarded as the first adjustment. Accordingly, the above adjustment calculation (T denoting the divider) is then applied from ② through segments ③ ④ ⑤ . . . ②). In the case of ②, the previous value is ①. Thus, the following formulas are developed:

$$X② = -(X①) + \frac{1 \times X_I}{T} - (0)$$

$$X③ = -(X②) + \frac{1 \times X_{II}}{T} - (0)$$

$$X④ = -(X③) + \frac{2 \times X_I}{T} - \frac{1 \times X_I}{T}$$

$$X⑤ = -(X④) + \frac{2 \times X_{II}}{T} - \frac{1 \times X_{II}}{T}$$

Etc.

As for Y②, Y③, Y④, Y⑤, . . . Y㉑, the following formulas are developed:

$$Y② = -(Y①) + \frac{1 \times Y_I}{T} - (0)$$

$$Y③ = -(Y②) + \frac{2 \times Y_{II}}{T} - (0)$$

$$Y④ = -(Y③) + \frac{2 \times Y_I}{T} - \frac{1 \times Y_I}{T}$$

$$Y⑤ = -(Y④) + \frac{2 \times Y_{II}}{T} - \frac{1 \times Y_{II}}{T}$$

-continued

Etc.

Repeating the above calculations from ① to ⑳, data values of the X, Y components are thus determined, and the relative positions of $I_1 \sim I_{10}$ and $II_1 \sim II_9$ are determined by setting 0.1 mm as the minimum unit. During the calculations, if the above data resulted in a fraction below the 0.1 mm unit, the fractions are adjusted to round values above 0.05 mm to 0.1 mm and the adjusted fraction is used in subsequent data calculations.

D. ADJUSTMENT FOR THE SELECTED STITCH INTERVAL

Figure 5D:
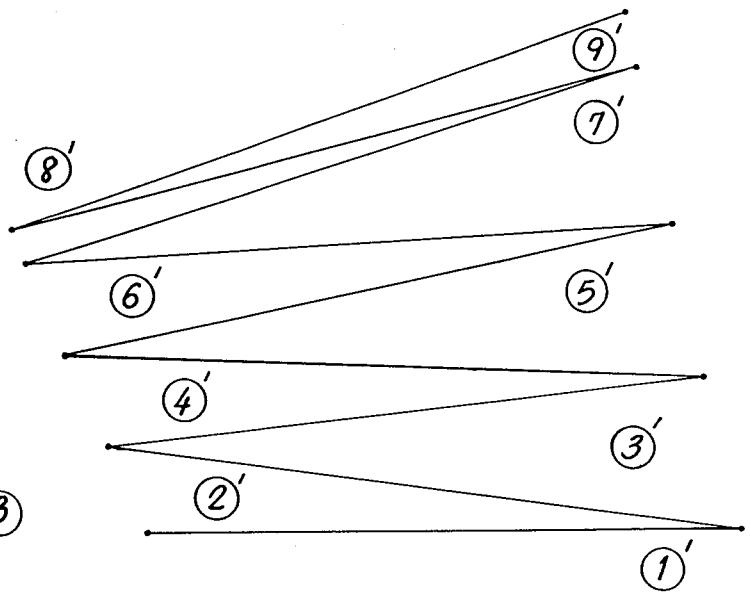
Figure 5C:
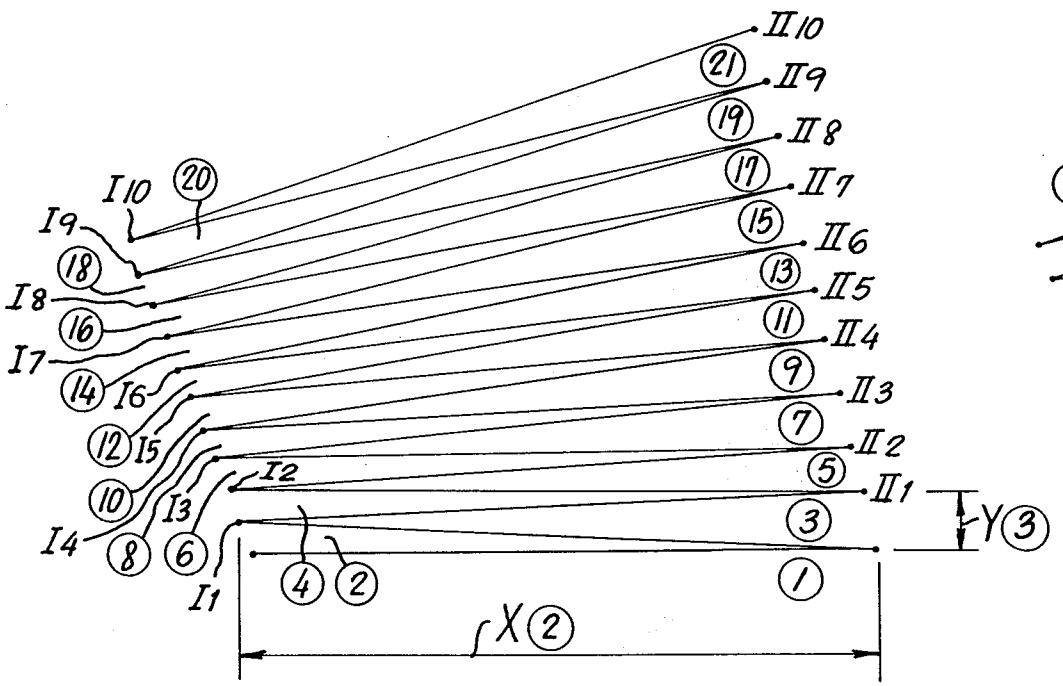

Referring to FIG. 5D, the stitch data ①', ②', ③', ... ⑧', ⑨' are calculated referring to the stitch data which was divided into the minimum units of 0.1 mm. Accordingly, stitch data of ① FIG. 5C can be regarded as corresponding to the stitch data of ①' in FIG. 5D. If the stitch interval P is selected as 3 (0.3 mm), the summation of the values of the X, Y components from segment ② to ⑥ become the stitch data of ②. Accordingly, the X component of the ② stitch data is $X_2$, $+X_3+X_4+X_5+X_6$ and the Y component of the ②'. stitch data is $Y_2+Y_3+Y_4+Y_5+Y_6$. As for the stitch data of ③, the stitch data 7 in FIG. 5C is the stitch data. As for the stitch data of ④, the stitch data is the summation from $X_8$ to $X_{12}$, and thus, the X component of the stitch data of ④ is $X_8+X_9+X_{10}+X_{11}+X_{12}$, and the Y component of the stitch data of ④, is $Y_8+Y_9+Y_{10}+Y_{11}+Y_{12}$.

Repeating each such calculation, the stitch data is then stored in the stitch data area of RAM 15. In this example, the stitch data up to ⑦' is calculated as described above, but in case of the stitch data of ⑧', the X component is $X_{20}$ and Y component is $Y_{20}$.

First adjusting for the remaining stitch data, it is not the summation of the value of five components value. If , the selected stitch interval P 2, the summation of the value. When adjusting the remaining stitch data of the FIG. 4, the summation of the three components' values is computed (if the selected stitch interval is P=2.) The basic data of 4, 5 in Fig. 4 are read into the operation area of RAM 15 and, referring to FIG. 5A, setting the previous value of c as data item a, the same operations of (a,b,c) as described above are then followed for the "ENLARGEMENT" "CALCULATION OF DIVIDER" and "ADJUSTING OF MINIMUM STITCH INTERVAL" functions.

When adjustment for the selected stitch interval is conducted, the remaining data (data of ⑧ and ⑨ in FIG. 5D) is used as the first adjustment data. During the course of adjusting for the appointed stitch interval for the final data a,b,c, if the situation became as shown in FIG. 5D, (⑧' and ⑨' cannot be adjusted like ⑦' and ⑥'), the first adjusted data for ⑧' and ⑨ ' are stored as the stitch data.

It is to be understood that the above-described embodiment of the invention are illustrative only, and that modifications thereof may be made without departing from the scope and spirit of the invention.

What is claimed:

1. A method of preparing stitch data in an automatic sewing machine, comprising the steps of:

(a) storing stitch data for embroidery of a stitch pattern;

(b) calculating a first stitch position of the stitch pattern, said calculation comprising the steps of, (i) reading out three basic stitch data items as one process unit, (ii) multiplying each of the basic stitch data items of said one process unit by a magnification factor, (iii) adjusting each of said multiplied stitch data items to divide the stitch pattern into minimum stitch intervals, and (iv) summing each of said adjusted stitch data items corresponding to the multiplied stitch data of the selected stitch interval;

(c) calculating each subsequent stitch position of the stitch pattern, each subsequent stitch position calculated based on the previous stitch position; and (d) moving one or both of a workpiece retainer and a sewing machine body relative to each other in accordance with each calculated stitch position.

2. The method of claim 1, wherein said stitch pattern is a zigzag stitch.

3. The method of claim 1, wherein the step of adjusting each of said multiplied stitch data items further comprises:

(a) calculating a divider equal to the largest absolute value of the sum of said multiplied data items; and (b) adjusting the minimum stitch interval by calculating the data values of each stitch position and dividing by said divider using the previous stitch point as origin.

4. The method of claim 3, wherein the step of adjusting the minimum stitch interval further comprises calculating an adjustment according to the formula:

$$\text{first data adjustment} = -\text{previous data} + \frac{\text{divide index number} \times \text{adjusted data}}{\text{divider}} - \text{previous adjusted data}$$

5. An automatic sewing machine, comprising:

(a) means for storing stitch data for embroidery of a stitch pattern;

(b) means for calculating a first stitch position of the stitch pattern comprising:

(i) means for reading out three basic stitch data items as one process unit;

(ii) means for multiplying each of the basic stitch data items of said one process unit by a magnification factor;

(iii) means for adjusting each of said multiplied stitch data items to divide the stitch pattern into minimum stitch intervals;

(iv) means for summing each of said adjusted stitch data items corresponding to the multiplied stitch data of the selected stitch interval;

(c) means for calculating each subsequent stitch position based on the previous stitch position; and (d) means for moving one or both of a workpiece retainer and a sewing machine body relative to each other in accordance with each calculated stitch position.

6. An automatic sewing machine, comprising:

(a) means for storing stitch data for embroidery of a stitch pattern;

(b) means for calculating a first stitch position of the stitch pattern, said calculation means comprising, (i) means for reading out three basic stitch data items as one process unit, (ii) means for multiplying each of the basic stitch data items of said one process unit by a magnification factor, (iii) means for adjusting each of said multiplied stitch data items to divide the stitch pattern into minimum stitch intervals, and (iv) means for summing each said adjusted stitch data items corresponding to the multiplied stitch data of the selected stitch interval;

(c) means for calculating each subsequent stitch position of the stitch pattern, each subsequent stitch position calculated based on the previous stitch position; and (d) means for moving one or both of a workpiece retainer and a sewing machine body relative to each other in accordance with each calculated stitch pattern.

7. The apparatus of claim 6, wherein said means for adjusting each of said multiplied stitch data items further comprises:

(a) means for calculating a divider equal to the largest absolute value of the sum of said multiplied data items; and (b) means for adjusting the minimum stitch interval by calculating the data values of each stitch position and dividing by said divider using the previous stitch point as origin.

* * * * *